US005381850A

United States Patent [19]

Otte et al.

[11] Patent Number: 5,381,850

[45] Date of Patent: Jan. 17, 1995

[54] COMPOSITE CASTING PROCESS

[75] Inventors: Bernd Otte, Zirndorf; Rudolf Schwarz, Nürnberg, both of Germany

[73] Assignee: Alcan Deutschland GmbH, Germany

[21] Appl. No.: 941,055

[22] PCT Filed: Apr. 9, 1992

[86] PCT No.: PCT/EP91/00668

§ 371 Date: Oct. 13, 1992

§ 102(e) Date: Oct. 13, 1992

[87] PCT Pub. No.: WO91/16159

PCT Pub. Date: Oct. 31, 1991

[30] Foreign Application Priority Data

Apr. 12, 1990 [DE] Germany ..... 4011948

[51] Int. Cl.[6] ..... B22D 19/14

[52] U.S. Cl. ..... 164/104; 164/97; 164/100

[58] Field of Search ..... 164/91, 97, 98, 100, 164/101, 102, 104

[56] References Cited

U.S. PATENT DOCUMENTS

| | | | |
|---|---|---|---|
| 4,676,064 | 6/1987 | Narita | 164/98 |
| 4,687,043 | 8/1987 | Weiss | 164/97 |
| 4,696,866 | 9/1987 | Tanaka | 164/97 |
| 5,000,249 | 3/1991 | Burke | 164/97 |

FOREIGN PATENT DOCUMENTS

| | | | |
|---|---|---|---|
| 0346771 | 12/1989 | European Pat. Off. . | |
| 1808843 | 8/1969 | Germany | 164/100 |
| 2701421 | 7/1977 | Germany . | |
| 3511542 | 10/1986 | Germany . | |
| 57-43952 | 3/1982 | Japan | 164/97 |
| 63-297277 | 12/1988 | Japan . | |
| 2033805 | 5/1980 | United Kingdom | 164/100 |
| 2162104 | 1/1986 | United Kingdom . | |
| 2173436 | 10/1986 | United Kingdom . | |
| 2194277 | 3/1988 | United Kingdom | 164/100 |

*Primary Examiner*—P. Austin Bradley
*Assistant Examiner*—Erik R. Puknys
*Attorney, Agent, or Firm*—Stevens, Davis, Miller & Mosher

[57] ABSTRACT

Composite casting process for making castings, consisting in particular of light metal alloys reinforced by fiber or foamed material inserts, in particular motor parts such as pistons, cylinders, cylinder heads and motor blocks of internal combustion engines. In this process, firstly, a preform reinforced by the fiber or foamed material inserts is made by embedding and the penetration of a fiber bundle or a foamed material body in molten matrix metal or by a molten matrix metal and subsequently solidifying it. Then, the preform is immersed in a molten metal bath and subsequently inserted into a casting mould for integrally casting or casting around the final casting. In accordance with the invention, the preform is immersed into a molten metal bath which consists of the same or a similar metal or the same or similar metal alloy as the matrix metal of the preform or the metal used for integral casting or casting around the final casting and which is heated to a temperature which is higher than the melting point of the matrix material.

11 Claims, No Drawings

COMPOSITE CASTING PROCESS

BACKGROUND OF THE INVENTION

The invention relates to a composite casting process for making castings consisting in particular of light metal alloys reinforced by inserts, for example, of fiber-shaped or open-pored materials or the like, in particular, motor parts such as pistons, cylinders, cylinder heads and motor blocks of internal combustion engines, for example, in which process, firstly, a preform reinforced by the insert or inserts is made by embedding and/or the penetration of the insert(s) or an insert bundle, for example a fiber bundle, in molten matrix metal or by a molten matrix metal and subsequently solidifying it, then immersing it in a molten metal bath and subsequently inserting it into a casting mould for integrally casting or casting around the final casting.

Such a composite casting process is known from DE-PS-27 01 421 and DE-OS-35 11 542. This known processing method is particularly useful for the manufacture of larger and complicatedly structured fiber-reinforced castings and enables the required orientation of the fibers or whiskers to the main loading direction in the casting which is to be manufactured to be carried out in a manner relatively simple.

Therefore, the fiber or whisker reinforced preform must be made in a special casting process in which the matrix metal of the preform is forced into the fiber or whisker bundle at a controlled filling speed and at an exactly dosed pressure in order to ensure a faultless wetting of each individual fiber or whisker as well as the formation of a gap free substance-lacked bond and/or force-locked composite action between the fiber or whisker material and the matrix metal. The matrix metal is then allowed to solidify.

The subsequent integral casting or casting around of the final casting to or around the preform can then result by means of a simple casting process. The casting of the entire, final casting by means of the specialized casting process necessary for the manufacture of the preform will not be useful for the manufacture of larger and complicatedly structured castings as the required casting device would be too complicated and the casting parameters hardly controllable.

The initially described known composite casting process is, however, equally not without problems. Thus, the preform to be inserted into the casting mould is as a rule covered on its surface by an oxide skin which hinders or renders impossible a gapless metallurgical bond with the metal integrally cast or cast around. In order to have any chance at all of the formation of a metallurgical bond of the preform with the metal integrally cast or cast around, the preform must be inserted into the casting mould preheated to a relatively high temperature, which results in an increase in the oxide skin occuring on its surface. Thus, only an intensive flowing around of the preform with the integrally cast or cast around metal can lead to an oxide free bond.

In order to achieve such a faultless bond, in the known process according to DE-OS 35 11 542, the preform is submerged into a melt of a lead alloy heated to 150° C.–400° C. before its insertion into the casting mould in order to release its oxide skin. The lead alloy which adheres in this case is provided to prevent the renewed formation of an oxide layer on the metal surface of the preform prior to the integral casting or casting around of the final casting.

However, this known process has the disadvantage that the alloy elements of the lead melt enter into the bond layer between the precast and the integrally cast or cast around metal and can have an unforeseeable influence in this layer on the properties of the layer and under circumstances, even on the whole, final casting. Additionally, the preheating transmitted to the preform by a lead melt heated to only 150°–400° C. is as a rule not sufficient to ensure the complete bond of the preform with the integrally cast or cast around metal.

The melting regions of aluminium casting alloys lie between 540° C. and 600° C. A preform placed in the casting mould at a substantially lower temperature leads to the melt of the integrally cast or cast around solidifying immediately at the boundary surface to the preform so that the formation of a gapless metallurigal bond between this metal and the preform cannot be ensured in a sufficiently reliable manner.

SUMMARY OF THE INVENTION

It is therefore an object of the invention to ensure in as simple a manner as possible, a gapless, acceptable metallurgical bond between the preform and the integrally cast or cast around metal in a composite casting process of the type initially revealed. This is achieved in accordance with the invention in that the preform of a first metal is immersed, prior to its insertion into the casting mould, into a molten second metal bath which consists of the same or a similar metal or the same or similar metal alloy as the matrix first metal of the preform or the metal used for the third final casting and which is heated to a temperature which is higher than the melting point of the matrix material. With this, it is taken into account that the matrix first metal of the preform in the melt second metal bath is at least substantially molten.

DETAILED DESCRIPTION OF A PREFERRED EMBODIMENT

The present invention is based on the recognition that in the above described example, the insert or the insert bundle in the preform such as, for example, a fiber bundle or an open-pored foamed body, in connection with the adhesion and cohesion forces of the matrix first metal surrounding each fiber or the structure of the foamed material or the like, provides the entire composite of the preform with a sufficient stability for its conveyance into the casting mould and its subsequent integral casting or casting around. This surprising stability goes so far that the preform can be subjected to a rotating or reciprocating movement in the molten metal bath in order to wash its surface free from adhering oxides without it disintegrating in the molten metal bath. It is naturally a perquisite that the insert or the insert bundle itself is composed in such a manner as to be able to withstand the thermic and chemical conditions during the immersion step. This bond stability of the preform also in the substantially or entirely molten condition of its matrix first metal is surprising, as one has assumed up to now that the softening or melting of the preform is to be avoided in every case for stability reasons.

The preform pretreated in accordance with the invention has after its transfer into the casting mould a temperature which still lies close to the casting temperature of the integrally cast or cast around third metal, as the melting heat of the matrix first metal in the preform prevents its quick recooling to below the melting temperature.

The oxide skin unavcidably forming on the molten first metal surface of the preform after its removal from the molten second metal bath can be easily washed off by the flow of the casting metal during the integral casting or casting around process so that a clean bonding of the molten alloys in the matrix, the surface layer and the casting third metal can be achieved with the greatest possible certainty without disturbing alloy elements being drawn into this composite.

The integral casting into the final casting of the pretreated preform reinforced by the inserts can result by means of any desired casting process such as sand casting, chill casting, low-pressure casting or pressure casting and the variants thereof in accordance with the inventive composite casting process. With this, an aluminium-silicon-alloy, for example, commercially available G Al Si 12 Cu Ni Mg, can be used as the integrally cast or cast around third metal.

The insert or the insert bundle can be impregnated under pressure with the matrix first metal and be embedded in this metal during the manufacture of the preform in such a manner that its volume amounts to at least 10% of the entire volume of the preform. For the preform, an insert of, for example, open-pored foamed graphite, foamed ceramic, foamed metal or the like or a fiber bundle can be used, the fibers of which, for example, consist of the predominant amount, as for example 95%, of aluminium oxide ($Al_2O_3$) and of smaller amounts, as for example 5%, of silicon oxide ($SiO_2$). The matrix first metal of the preform can be aluminium with a melting point of about 660° C.

For the immersion melt bath, for example, an aluminium-silicon-alloy second metal such as A1SilO can be used which can be brought up to a bath temperature of over 700° C., preferably approximately 780° C. In this melt bath, the preform can be immersed in accordance with its size for one or several minutes until it has been fully heated throughout.

As the matrix first metal of the preform is completely or substantially in a molten state after its immersion bath treatment, like the casting, the preform is subjected to normal solidification shrinkage during the solidification of the entire, final casting. In order to avoid the occurance of shrinkage cavities within the casting, precautions are to be taken in the casting mould by means of which the matrix metal in the insert body or in the insert bundle or the like are included in the controlled solidification progression of the final casting.

We claim:

1. In a composite casting process for making light metal castings reinforced by inserts of fiber-shaped or open-pored materials comprising pistons, cylinders, cylinder heads and motor blocks of internal combustion engines, said process including firstly, making a preform reinforced by at least one insert of fiber-shaped or open-pored materials by embedding the insert in a first matrix metal while molten and subsequently solidifying said first matrix metal and then immersing the preform in a second molten metal bath and subsequently inserting the preform into a casting mould for integrally casting or casting around the final casting of a third metal, wherein the improvement comprises said second molten metal bath being of the same or a similar metal as said first matrix metal of the preform or said third metal used for the final casting and heating said second molten metal bath to a temperature which is higher than the melting point of said first matrix metal.

2. Composite casting process according to claim 1, including immersing the preform into the second metal bath while molten in such a manner that the second matrix metal of the preform is completely or substantially molten in the bath, and that said preform is subsequently inserted while in this molten condition into the casting mould for integrally casting or casting around the final casting.

3. Composite casting process according to claim 1, including moving the preform in a rotary or reciprocating manner in the molten second metal bath.

4. Composite casting process according to claim 1, including impregnating said at least one insert with said first matrix metal under pressure in such a manner that the volume of said first matrix metal amounts to at least 10% of the total volume of the preform.

5. Composite casting process according to claim 1, in which said at least one insert comprises a fiber bundle, the fibers of which consist of a predominating amount, of about 95%, of aluminium oxide ($Al_2O_3$) and of about 5%, of silicon oxide ($SiO_2$).

6. Composite casting process according to claim 1, in which said insert is a foamed material selected from the group consisting of open-pored foamed graphite, foamed ceramic, and foamed metal.

7. Composite casting process according to claim 1, including washing from the preform an oxide skin which forms on the molten surface of the preform.

8. Composite casting process according to claim 1, including using an aluminum with a melting point of about 660° C. as the first matrix metal of the preform.

9. Composite casting process according to claim 1, including using an aluminum-silicon-alloy, for example AlSilO, which is raised to a bath temperature of over 700° C., preferably approximately 780° C. for the immersion bath melt second metal.

10. Composite casting process according to claim 1, including varying the time that the preform is immersed into the molten second metal bath depending on the size of the preform until the preform is completely heated through.

11. Composite casting process according to claim 1, in which the integrally cast or cast around third metal consists of an aluminum-silicon-alloy, for example of G Al Si 12 Cu Ni Mg.

* * * * *